US006938608B2

(12) United States Patent
Wijaya

(10) Patent No.: US 6,938,608 B2
(45) Date of Patent: Sep. 6, 2005

(54) AIR FLOW-TWISTING DEVICE ON AN AIR INLET SYSTEM OF INTERNAL COMBUSTION ENGINE

(76) Inventor: Heru P. Wijaya, Graha Famili D. 183 P.R., Kali Kendal, Surabaya 60226 (ID)

( * ) Notice: Subject to any disclaimer, the term of this patent is extended or adjusted under 35 U.S.C. 154(b) by 330 days.

(21) Appl. No.: 10/376,134

(22) Filed: Feb. 28, 2003

(65) Prior Publication Data

US 2003/0221662 A1 Dec. 4, 2003

Related U.S. Application Data

(63) Continuation-in-part of application No. 09/509,439, filed as application No. PCT/IB99/00029 on Jan. 11, 1999, now abandoned.

(30) Foreign Application Priority Data

Jul. 28, 1998 (ID) ..... S 980077

(51) Int. Cl.[7] ..... F02B 31/00
(52) U.S. Cl. ..... 123/306
(58) Field of Search ..... 123/306, 590, 123/592, 593

(56) References Cited

U.S. PATENT DOCUMENTS

| | | | | |
|---|---|---|---|---|
| 1,606,916 | A | | 11/1926 | Bagley |
| 2,017,043 | A | | 10/1935 | Galliot |
| 2,639,230 | A | | 5/1953 | Lefebre |
| 3,591,148 | A | | 7/1971 | Schmitz |
| 4,013,137 | A | | 3/1977 | Petersen |
| 4,015,575 | A | | 4/1977 | Fox |
| 4,092,966 | A | | 6/1978 | Prosen |
| 4,205,526 | A | | 6/1980 | Owens |
| 4,303,373 | A | | 12/1981 | Polhemus |
| 4,359,026 | A | * | 11/1982 | Holthausen et al. ..... 123/306 |
| 4,478,198 | A | | 10/1984 | Bruhn |
| 4,515,138 | A | | 5/1985 | Agadi |
| 4,580,544 | A | | 4/1986 | Walker |
| 4,760,821 | A | | 8/1988 | Aupor et al. |
| 4,962,642 | A | | 10/1990 | Kim |
| 5,571,242 | A | | 11/1996 | Demorest |
| 5,572,979 | A | | 11/1996 | Czadzeck |
| 6,170,460 | B1 | | 1/2001 | Buswell et al. |
| 2004/0206330 | A1 | * | 10/2004 | Wijaya ..... 123/306 |

FOREIGN PATENT DOCUMENTS

| | | | | |
|---|---|---|---|---|
| DE | 39 05 894 A1 | | 10/1989 | |
| FR | 362 694 | | 7/1906 | |
| FR | 728 486 | | 7/1932 | |
| GB | 399 679 | | 10/1933 | |
| GB | 2 275 081 | | 8/1994 | |
| JP | 4-103869 A | * | 4/1992 | ..... F02M/35/24 |
| JP | 8-28281 | | 1/1996 | |
| WO | WO 94/10437 | | 5/1994 | |
| WO | WO 96/38217 | | 12/1996 | |

* cited by examiner

*Primary Examiner*—Hieu T. Vo
(74) *Attorney, Agent, or Firm*—Christie, Parker and Hale, LLP

(57) ABSTRACT

The invention relates to an air flow twisting device that can twist the air in an air inlet system of internal combustion engine. This device can be installed between an air filter and an engine combustion chamber. The device includes a body having a bore therethrough and a length. The device can be made from various materials such as metals, polymers or ceramics.

29 Claims, 7 Drawing Sheets

AIR FLOW-TWISTING DEVICE ON AN AIR INLET SYSTEM OF INTERNAL COMBUSTION ENGINE

CROSS-REFERENCE TO RELATED APPLICATION(S)

This application is a continuation-in-part of U.S. patent application Ser. No. 09/509,439, filed on Mar. 27, 2000, now abandoned which is a National Phase Patent Application of International Application Number PCT/IB99/00029, filed on Jan. 11, 1999, which claims priority of Indonesia Patent Application Number S 980077, filed Jul. 28. 1998.

FIELD OF THE INVENTION

The present invention relates to an air flow-twisting device on an air inlet system of an internal combustion engine, particularly an air flow-twisting device installed after an air filter as an accessories means of an air inlet system is disclosed.

BACKGROUND OF THE INVENTION

Currently, internal combustion engines are modified to have high performance. One important aspect of an internal combustion engine is a perfect mixture of air and fuel, i.e., a homogeneous and proportional mixture of air and fuel. Clean air that can be perfectly mixed with fuel is a must.

A variety of air inlet systems have been created for a better combustion effect. These systems have improved shapes or other supporting elements. However, such improved shapes and supporting elements have limited function in increasing the speed and cleanliness of the air inlet systems that provide flow into the engine mixture chamber of air and fuel after passing the air filter to achieve a complete combustion level and a low waste gas emission.

In order to improve the combustion process of an internal combustion engine, it is required to design a better device or supporting elements in the air inlet system. Such design can increase the mixture of air and fuel flowing uniformly into the internal combustion engine.

SUMMARY OF THE INVENTION

The present invention is made due to the problems that presently exist in the prior art. Therefore, the present invention includes an air flow-twisting device that may be installed in the air inlet system between the air filter and combustion chamber of an engine, wherein the device provides an enhanced stirred effect and mixture of air and fuel in the combustion chamber for improving the combustion process and engine performance.

BRIEF DESCRIPTION OF THE DRAWINGS

The objects and features of the invention will be made apparent as the detailed description progresses referring to the enclosed drawings, wherein.

DETAILED DESCRIPTION

Figure 1A:
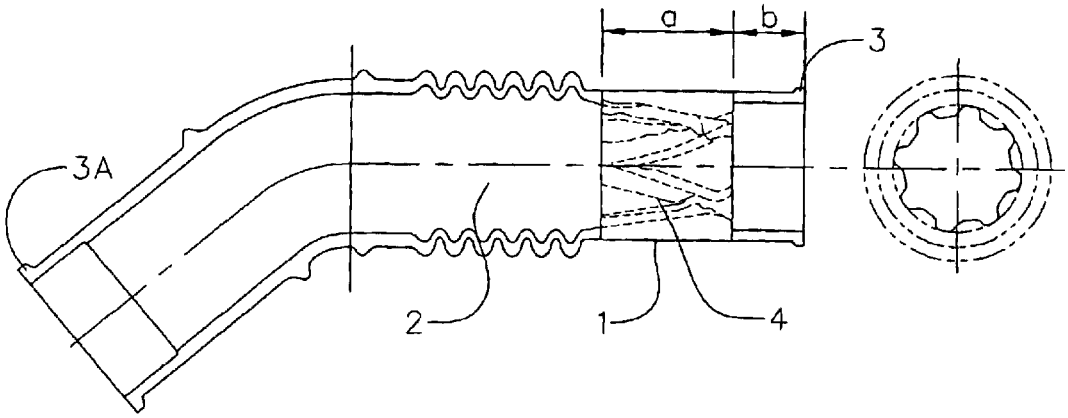
FIG. 1*a* is a two-dimensional cross sectional view of an exemplary embodiment of an air flow-twisting device of the present invention installed on a rubber tube on an internal combustion engine.
Figure 1B:
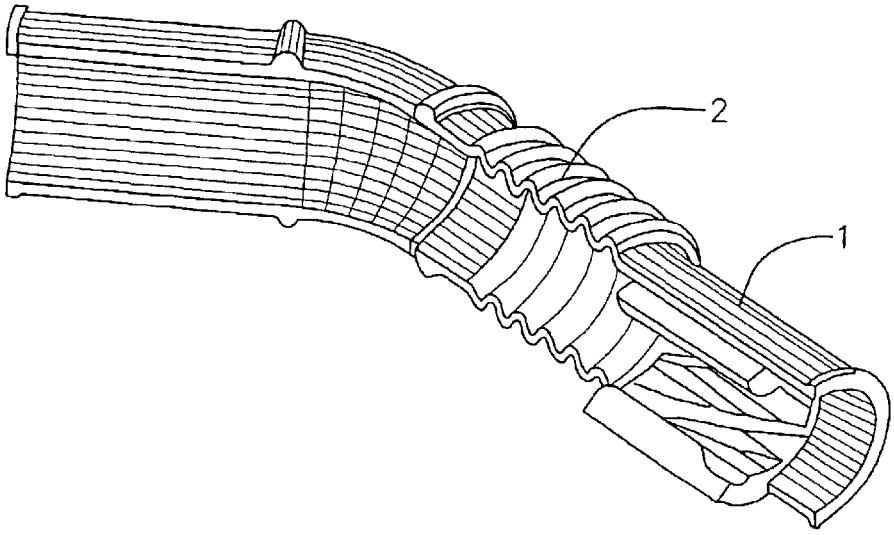
FIG. 1*b* is perspective cut away view of an exemplary embodiment of an air flow twisting device of the present invention installed on a rubber tube on an internal combustion engine.

Referring to FIGS. 1*a* and 1*b*, an air flow twisting device (1) for an internal combustion engine installed on a rubber tube (2) of an air inlet system is shown. The air flow twisting device (1) has a tubular shape having a wall thickness that may correspond to a wall thickness of a rubber tube (2). The air flow twisting device (1) also includes a cylindrical flange (3) at an end thereof. A flange (3A) may also be formed at an end of the rubber boot. Typically, the air flow twisting device (1) is coupled to the rubber tube (2) or other manifold which provides air to the air flow twisting device (1) preferably after the air has been filtered by an engine air filter (not shown).

A first portion of the air flow twisting device (1) has a length (a) of about two-thirds of the length of the body of the air flow twisting device (1), and is formed with helically extending grooves (4). The grooves are formed on the inner surface of the tubular wall of the device and twist along the length of the first portion (a) of the device. The grooves twist as they extend along the length of the device body. In the embodiment depicted in FIG. 2, the grooves span only an arcuate portion of the circumference of the inner surface of the tubular. The grooves (4) may twist along this arcuate portion of the circumference of the inner surface of the tubular wall. Preferably, the grooves are spaced apart and are uniform along their length. The remaining one-third of the length (b) of the body of the air flow twisting device (1) is a regular inner circumferential surface. The cylindrical flange end (3) of the air flow twisting device (1) is connected onto an intake manifold (not shown) of the internal combustion engine having an injection system or intake carburetor (not shown) when the engine uses a carburetor. An air flow twisting device (1) of the present invention can be made from various materials such as metal, polymer or ceramic.

Figure 2:
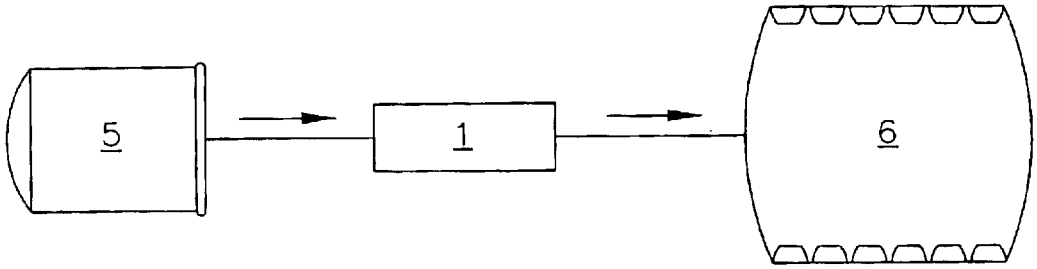
FIG. 2 is a schematic diagram indicating the position of an exemplary embodiment of an air flow twisting device of the present invention in the air inlet system of an internal combustion engine.

FIG. 2 illustrates a schematic diagram which indicates a position of air flow twisting device in an air inlet system of an internal combustion engine. The air flow twisting device (1) is substantially placed between an air filter (5) and an internal combustion engine (6). The air flow twisting device (1) can be installed in the air inlet system of internal combustion engine without changing the basic construction of the engine. Air flowing in after the air filter (5) is directed through air flow twisting device (1). When passing through the first portion (a) of the air flow twisting device (1), the twisting grooves (4) impart a twisting motion on the air such that when the air flows out of the air flow twisting device it has a twisting motion. Next, the twisted air creates a uniformly dispersed mixture of air and fuel causing a stirred effect which creates a more homogenous distribution of the air and fuel mixture in the combustion chamber (6) and accordingly enhances the engine performance.

Figure 3:
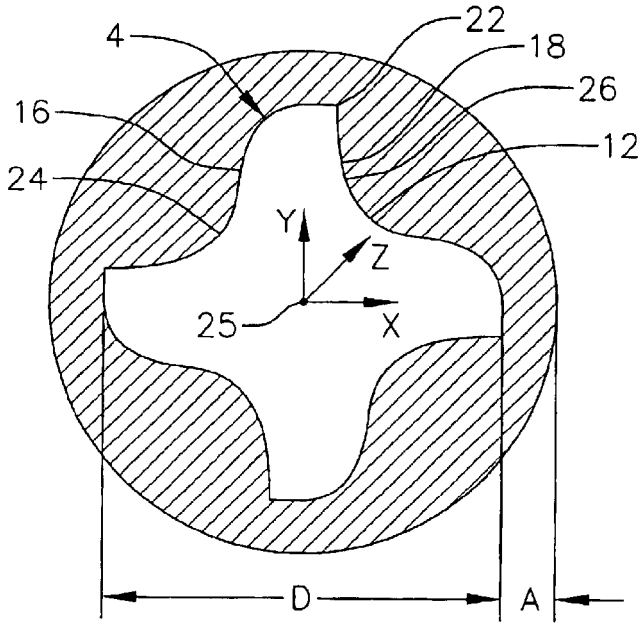
FIG. 3 is a cross-sectional view of an exemplary embodiment of an air flow twisting device according to the present invention showing an exemplary cross-sectional shape of an inner surface of the air flow twisting device.

FIG. 3 shows an exemplary cross-sectional shape of an inner surface (12) of the air flow twisting device (1). In the exemplary depicted embodiment, the inner surface (12) is defined by four identical grooves (4) that have a curved shape. The curved shape of the grooves (4) imparts a twisting motion on air that enters the air flow twisting device (1). As a result, when the air is mixed with fuel, the enhanced twisting motion of the air produces a more homogenous distribution of the air and fuel mixture and consequently enhances the performance of the associated engine.

FIG. 3 shows an exemplary shape for the grooves (4). As shown, each groove (4) has a first side (16), a second side (18) and a base (20). In one exemplary embodiment, the first side (16) of each groove (4) is concave and the second side (18) of each groove (4) is convex. For example, in the exemplary depicted embodiment, a concave surface (24) defines the first side (16) and the base (20) of each groove (4) and a convex surface (26) defines the second side (18) of each groove (4), such that each groove (4) is defined by the concave surface (24) and the convex surface (26), where the concave surface (24) is longer than the convex surface (26). As is also shown in FIG. 3, in an exemplary embodiment a junction (22) between the concave surface (24) and the convex surface (26) is a point. In alternative exemplary embodiments, the convex surface (26) may be longer than the concave surface (24) or the concave (24) and convex (26) surfaces may be substantially similar in length.

In one exemplary embodiment, such as that shown in FIG. 3, the inner surface (12) has diagonal symmetry, meaning that for any x-z plane extending through a center point (25) of the inner surface (12) (i.e. any plane extending through the longitudinal axis of the body of the air flow twisting device (1)), the portion of the inner surface (12) on one side of the plane is a mirror imagine that has been flipped 180 degrees about the x-axis of the portion of the inner surface (12) that is on an opposite side of the plane.

In the exemplary depicted embodiment of FIG. 3 as described above, the inner surface (12) is defined by four identical grooves (4) that are equally spaced about a radial cross-section of the air flow twisting device (1), where each groove (4) is radially opposite one of the other grooves (4). Although the depicted embodiment shows the inner surface (12) as having four equally spaced grooves (4), in alternative exemplary embodiments the inner surface (12) may include any number of grooves (4) having any appropriate radial spacing.

As shown in FIG. 3, the inner surface (12) also includes a dimension (D) that is defined as the outermost inner diameter of the air flow twisting device (1), or stated differently, the dimension (D) is the radial distance from the base (20) of one of the grooves (4) to the base (20) of its radially opposite groove (4). In one embodiment, the dimension (D) is chosen so as to minimize a distance (A), from the outer diameter of the air flow twisting device (1) to the base (20) of a groove (4).

Figure 4:
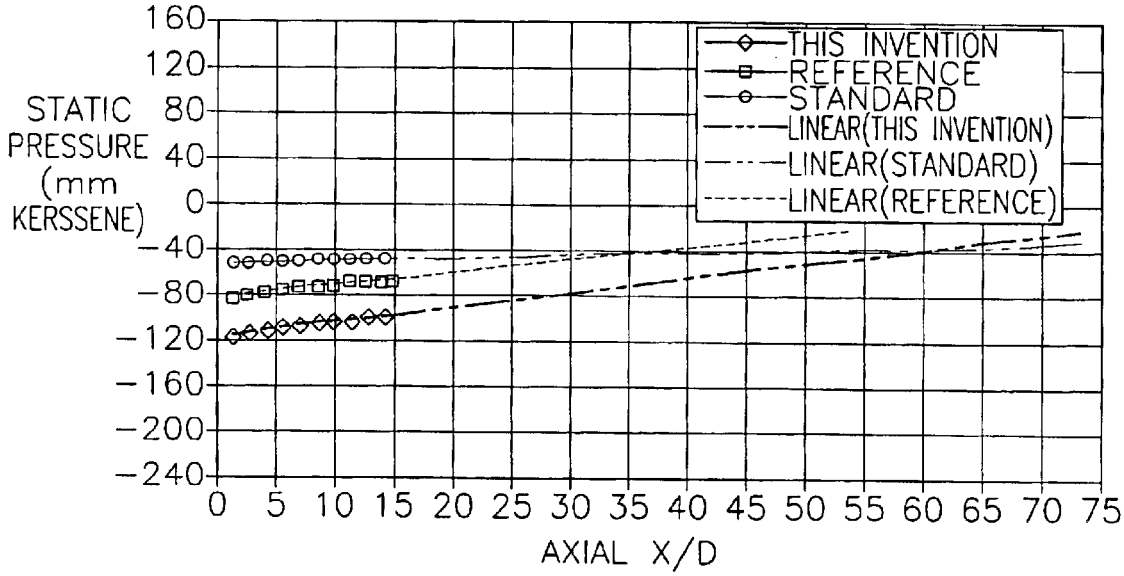
FIG. 4 shows a graph of the static pressure versus axial X/D for air leaving the air flow twisting device of FIG. 3 and for air leaving other devices.

FIG. 4 shows a graph of the static pressure versus axial X/D for air leaving an exemplary embodiment air flow twisting device (1) of the present invention and for air leaving other devices, wherein X is defined as the distance from the outlet end of the device to a point where the air ceases to twist and D is defined as explained above with reference to FIG. 3. The large X/D ratio for the exemplary embodiment air flow twisting device (1) of the present invention shows that the air twists for a longer distance after the air exists the air flow twisting device (1) as compared to other air flow twisting devices.

The geometric shape of the inner surface (12) shown in FIG. 3, allows for the air existing the exemplary embodiment air flow twisting device (1) to remain twisting for a large distance. As such, the air flow twisting device (1) of the present invention has the advantage of being able to be installed before or after the air filter.

The strength of the twisted air that exits from the exemplary embodiment air flow twisting device (1) of the present invention is facilitated by the shape of the inner surface (12) shown in FIG. 3. This shape causes a high secondary velocity around the air flow twisting device (1) (see FIG. 5) by keeping a high velocity at the center of the airflow (see FIG. 6). The secondary velocity is a velocity vector causing air to twist after exiting the air flow twisting device (1). The direction of each velocity vector is perpendicular to the radial axis of the air flow twisting device (1).

Figure 5:
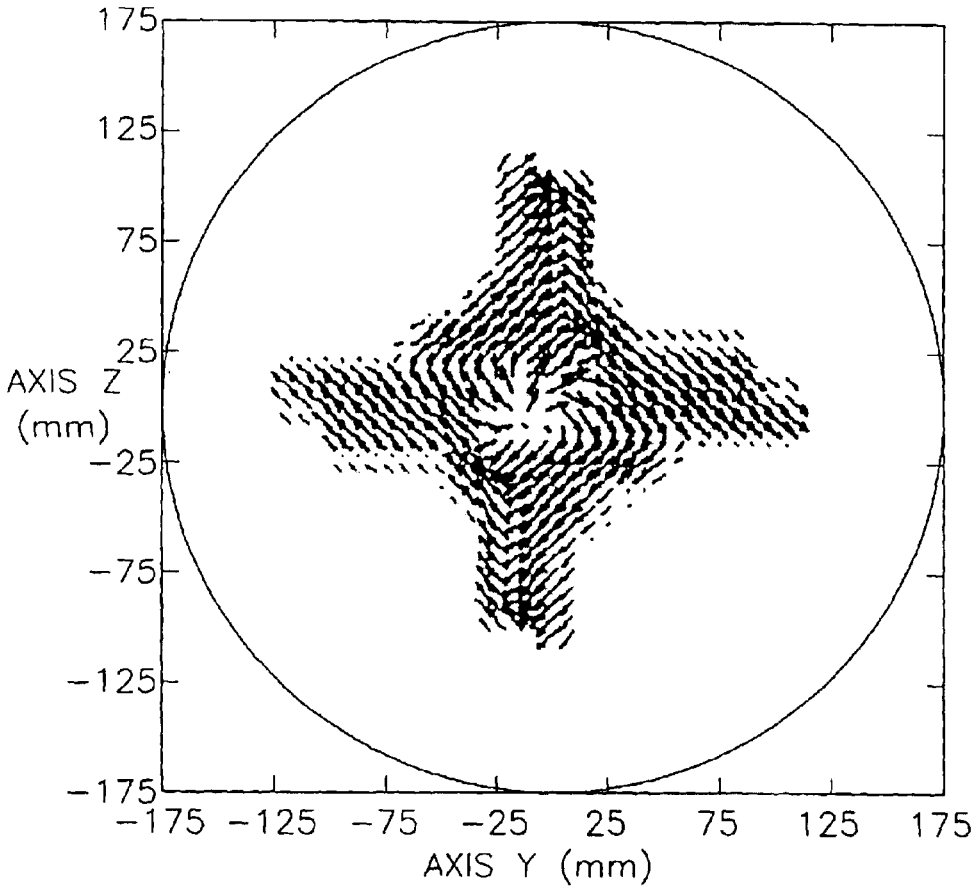
FIG. 5 shows the vector direction of the secondary velocity caused by the air flow twisting device of FIG. 3 at X/D=0.
Figure 6:
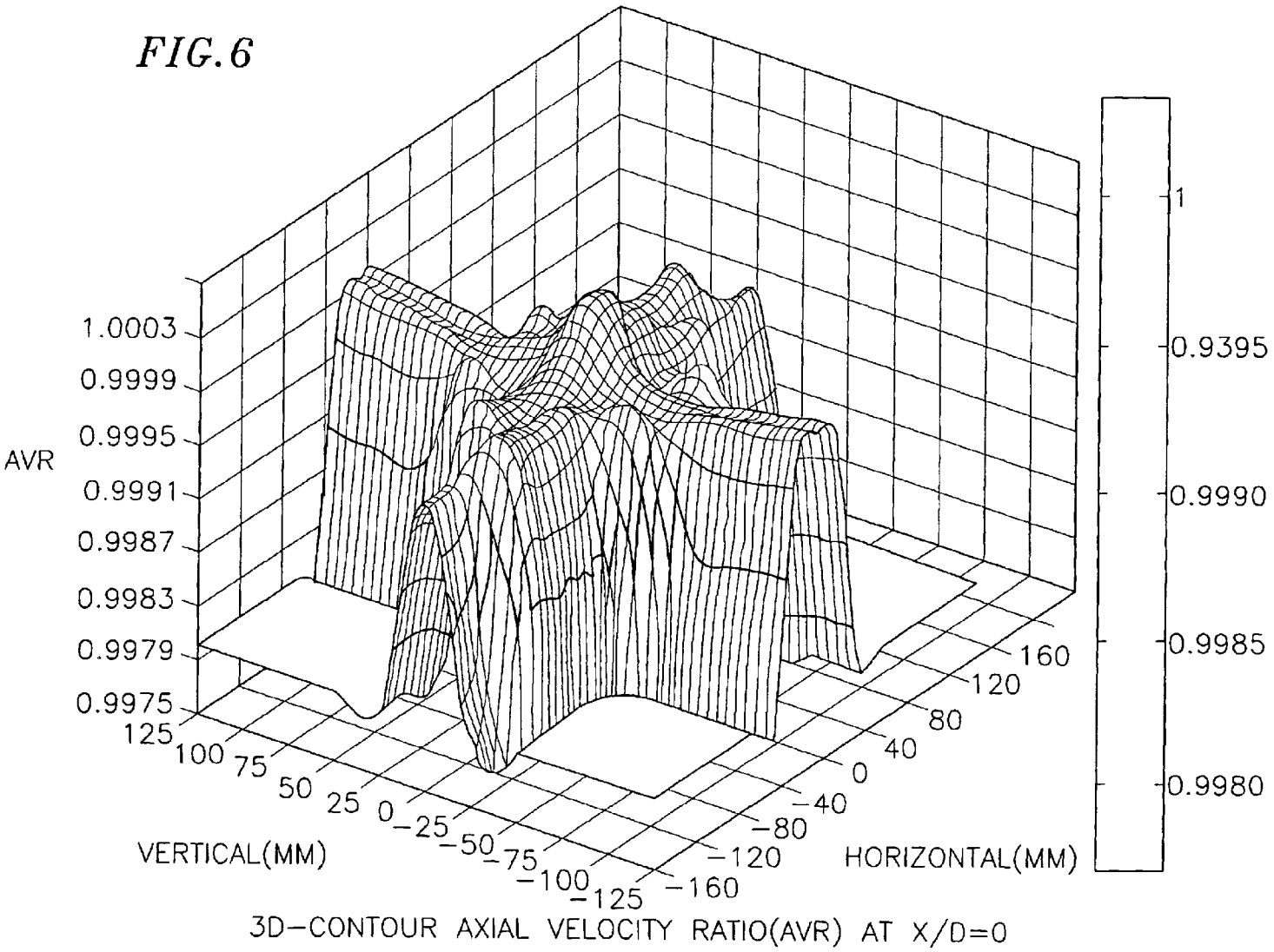
FIG. 6 is a distribution graph of the air flow velocity at X/D=0 for the air flow twisting device of FIG. 3.

FIG. 5 shows the vector direction of the secondary velocity at X/D=0 (i.e. directly after leaving the air flow twisting device (1)). FIG. 6 is a distribution graph of the axial velocity ratio (AVR) at X/D=0, showing that the air velocity is high at the center of the air flow twisting device (1), where AVR is a ratio between the axial velocity at a point after passing the air flow twisting device (1) and the axial velocity at a point before passing through the air flow twisting device (1).

Figure 7A:
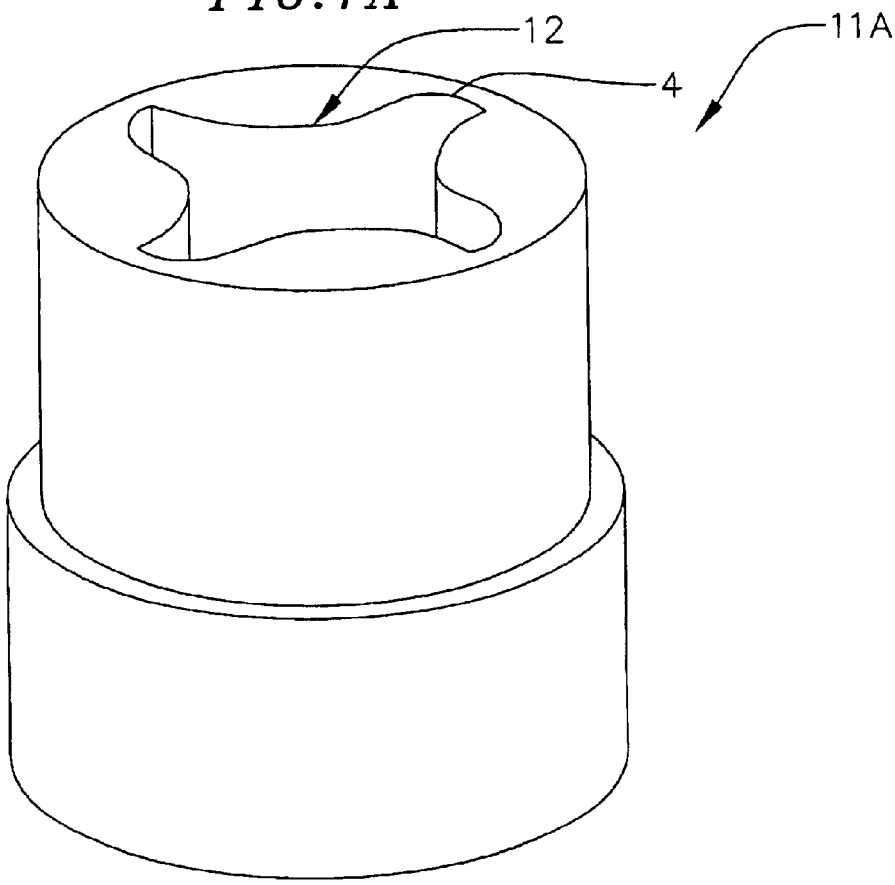
FIG. 7A shows an exemplary embodiment air flow twisting device according to the present invention that is insertable into an internal combustion engine.

FIG. 7A shows an exemplary embodiment an air flow twisting device (11A) that is insertable into an internal combustion engine, such as by being inserted into a rubber tube of an air inlet system of the internal combustion engine. For example, the air flow twisting device (11A) of FIG. 7A may be insertable into a rubber tube or other manifold of the an internal combustion engine which provides air to the air flow twisting device (11A). In an exemplary embodiment, air passes through the air flow twisting device (11A) after the air has been filtered by an engine air filter (not shown).

Figure 7B:
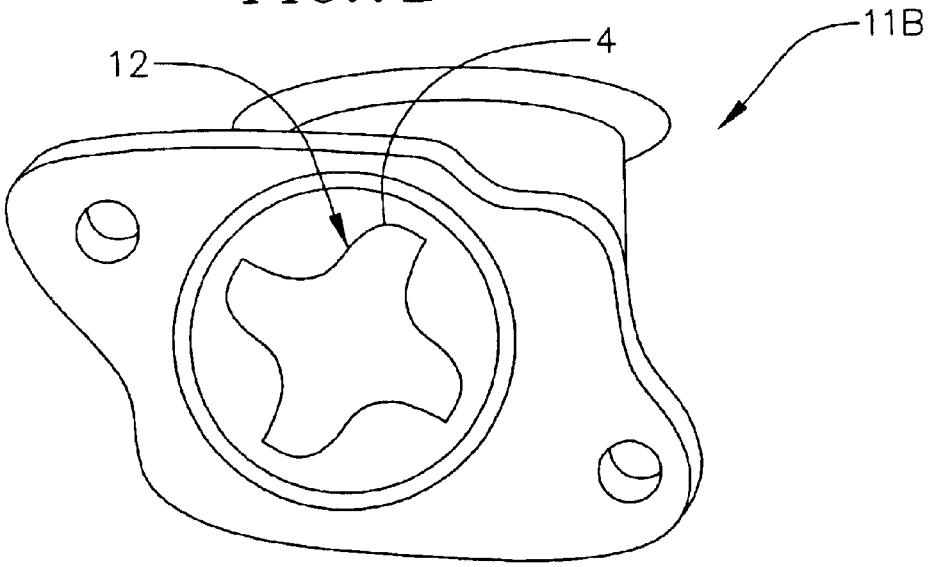
FIG. 7B shows an exemplary embodiment air flow twisting device according to the present invention that is formed as a part of a connector that is mountable on an internal combustion engine.

FIG. 7B shows an exemplary embodiment air flow twisting device (11B) according to the present invention that is formed as a part of a connector that is mountable on an internal combustion engine.

Figure 8:
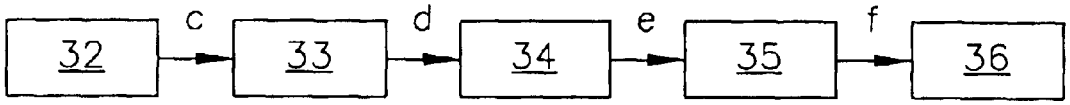
FIG. 8 is a schematic diagram of air flow through an internal combustion engine having a carburetor system.

FIG. 8 is a schematic diagram of air flow through an internal combustion engine having a carburetor system. As shown, air flows at a point (c) from an air filter 32 to an air hose 33, at a point (d) from the air hose 33 to a carburetor 34, at a point (e) from the carburetor 34 to an intake manifold 35 and at a point (f) from the intake manifold to a combustion chamber 36.

Figure 9:
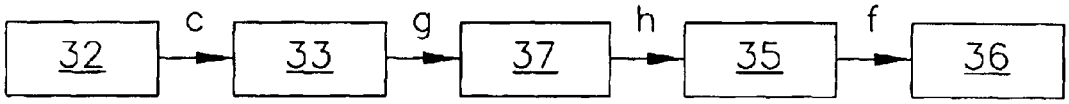
FIG. 9 is a schematic diagram of air flow through an internal combustion engine having an indirect injection system.

FIG. 9 is a schematic diagram of air flow through an internal combustion engine having an indirect injection system. As shown, air flows at the point (c) from the air filter 32 to the air hose 33, at a point (g) from the air hose 33 to a mixing chamber 37, at a point (h) from the mixing chamber 37 to the intake manifold 35 and at the point (f) from the intake manifold 35 to the combustion chamber 36.

Figure 10:
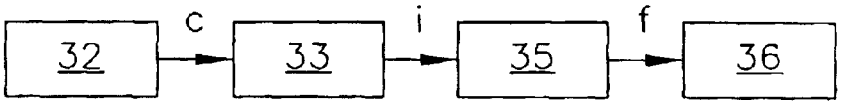
FIG. 10 is a schematic diagram of air flow through an internal combustion engine having a direct injection system.
Figure 3:
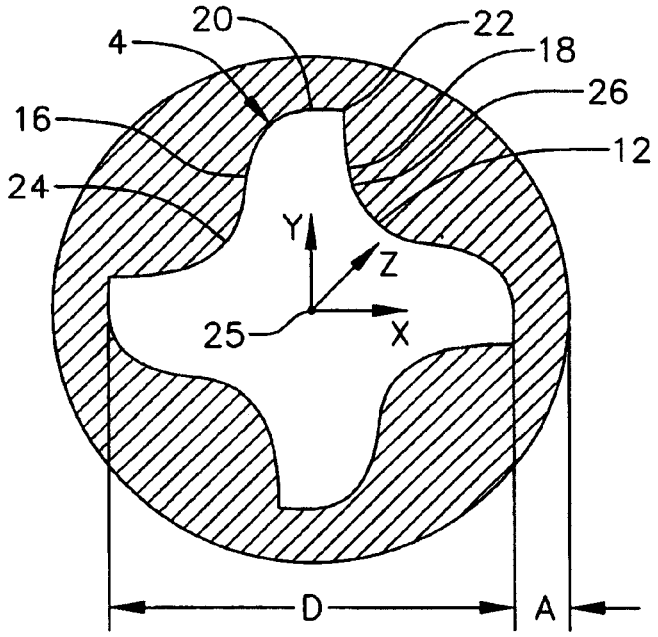
Figure 4:
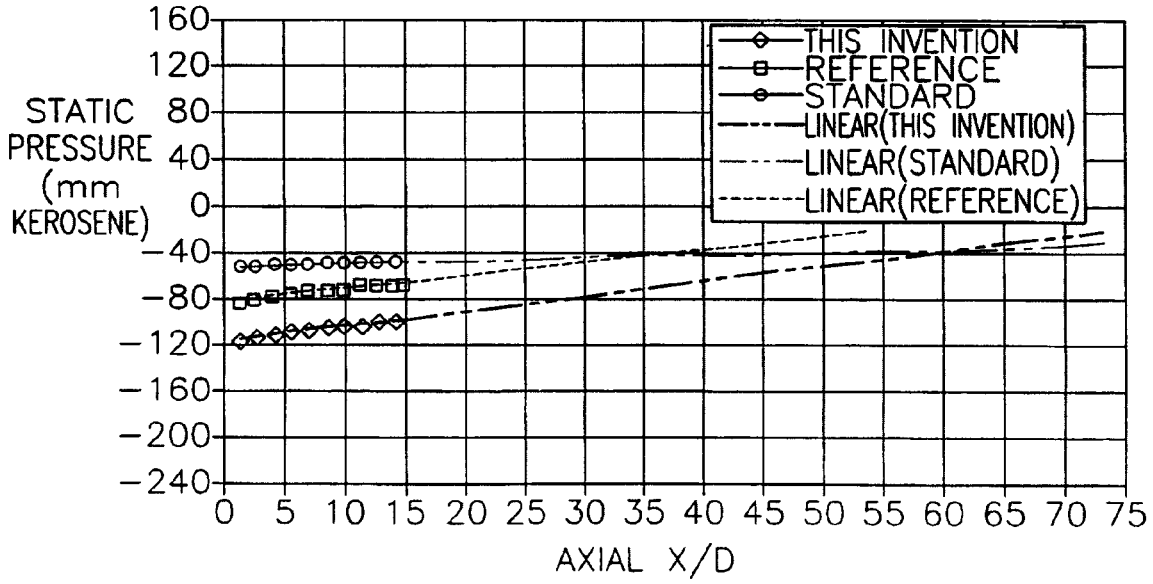

FIG. 10 is a schematic diagram of air flow through an internal combustion engine having a direct injection system. As shown, air flows at the point (c) from the air filter 32 to the air hose 33, at a point (i) from the air hose 33 to the intake manifold 35 and at the point (f) from the intake manifold to the combustion chamber 36.

Any of the exemplary embodiments described above for the air flow twisting device can be installed at any of the points (c), (d), (e), (f), (g), (h), or (i). For example, in an internal combustion engine having a carburetor system as shown in FIG. 8, the air flow twisting device can be installed at points (d) or (e), before or after the carburetor 34, in an internal combustion engine having an indirect injection system as shown in FIG. 9, the air flow twisting device can be installed at point (g), before the mixing chamber 37, and in an internal combustion engine having a direct injection system as shown in FIG. 10, the air flow twisting device can be installed at point (f), before the combustion chamber 36.

It is to be understood that the description above which refers to the drawings according to the present invention represents an illustration and explanation. All variations and modifications such as the material used to make the air flow twisting device are considered within the scope of invention stated in the enclosed claims.

What is claimed is:

1. An air flow twisting device for an internal combustion engine for providing air for combustion to a combustion chamber of an engine, the device comprising:

a tubular body having a length and an inner surface; and a groove on the inner surface and twisting along at least a portion of the length of the body such that air flowing through the body is caused to twist and thus have a twisting motion as it exits the body, wherein the groove spans only an arcuate portion of the body and begins at an end of the body and extends along a length of about two-thirds the length of the body.

2. The air flow twisting device of claim 1, comprising a plurality of grooves on the inner surface and twisting along at least a portion of the length of the body such that air flowing through the body is caused to twist and thus have a twisting motion as it exits the body, wherein each groove spans only an arcuate portion of the body and begins at an end of the body and extends along a length of about two-thirds the length of the body.

3. An air inlet system for an internal combustion engine comprising:

a manifold coupled to an air source for providing air from the air source; and an air flow twisting device comprising, a tubular body having a length and an inner surface, wherein the body is coupled at a first end to the manifold and at a second end to the engine combustion chamber, and a groove on the inner surface and twisting along at least a portion of the length of the body such that air flowing through the body is caused to twist and thus have a twisting motion as it exits the body, wherein the groove spans only an arcuate portion of the body and begins at an end of the body and extends along a length of about two-thirds the length of the body.

4. The air inlet system of claim 3, further comprising an air filter coupled to the air source for filtering the air provided to the manifold.

5. The air inlet system of claim 3, wherein the manifold is a rubber boot.

6. The air inlet system of claim 3, comprising a plurality of grooves on the inner surface and twisting along at least a portion of the length of the body such that air flowing through the body is caused to twist and thus have a twisting motion as it exits the body, wherein each groove spans only an arcuate portion of the body and begins at an end of the body and extends along a length of about two-thirds the length of the body.

7. The air inlet system of claim 6, wherein the plurality of grooves are spaced apart.

8. The air inlet system of claim 3, wherein the second end of the body is coupled to an air intake manifold for providing twisted air flow to the air intake manifold.

9. The air inlet system of claim 3, wherein the second end of the body is coupled to a carburetor for providing twisted air flow to the carburetor.

10. The air inlet system of claim 3, wherein the second end of the body is coupled to a mixing chamber for providing twisted air flow to the mixing chamber.

11. An air flow twisting device for an internal combustion engine for providing air for combustion to a combustion chamber of an engine, the device comprising:

a tubular body having a length and an inner surface; and a groove on the inner surface that twists along at least a portion of the length of the body such that air flowing through the body is caused to twist and thus have a twisting motion as it exits the body, wherein the groove spans only an arcuate portion of the inner surface, and wherein the groove comprises a first side, a second side and a base, wherein a concave surface defines the first side and the base, a convex surface defines the second side and a junction between the concave and convex surfaces is a point.

12. The air flow twisting device of claim 11, wherein the concave surface is longer than the convex surface.

13. The air flow twisting device of claim 11, wherein the groove begins at an end of the body and extends along a length of about two-thirds the length of the body.

14. The air flow twisting device of claim 11, comprising a plurality of grooves on the inner surface that each twist along at least a portion of the length of the body such that air flowing through the body is caused to twist and thus have a twisting motion as it exits the body, wherein each groove spans only an arcuate portion of the inner surface, and wherein each groove comprises a first side, a second side and a base, wherein a concave surface defines the first side and the base of each groove, a convex surface defines the second side of each groove and a junction between the concave and convex surfaces of each groove is a point.

15. The air flow twisting device of claim 14, wherein the concave surface of each groove is longer than the convex surface of each groove.

16. The air flow twisting device of claim 14, wherein each groove begins at an end of the body and extends along a length of about two-thirds the length of the body.

17. The air flow twisting device of claim 14, comprising four grooves.

18. The air flow twisting device of claim 14, wherein the inner surface has diagonal symmetry about any plane that extends through the longitudinal axis of the body.

19. An air flow twisting device for an internal combustion engine for providing air for combustion to a combustion chamber of an engine, the device comprising:

a tubular body having a length and an inner surface; and a groove on the inner surface that twists along at least a portion of the length of the body such that air flowing through the body is caused to twist and thus have a twisting motion as it exits the body, wherein the groove spans only an arcuate portion of the inner surface, and wherein the inner surface has diagonal symmetry about any plane that extends through the longitudinal axis of the body.

20. The air flow twisting device of claim 19, wherein the groove comprises a first side, a second side and a base, wherein a concave surface defines the first side and the base, a convex surface defines the second side and a junction between the concave and convex surfaces is a point.

21. The air flow twisting device of claim 19, wherein the groove begins at an end of the body and extends along a length of about two-thirds the length of the body.

22. The air flow twisting device of claim 19, comprising a plurality of grooves on the inner surface that each twist along at least a portion of the length of the body such that air flowing through the body is caused to twist and thus have a twisting motion as it exits the body, wherein each groove spans only an arcuate portion of the inner surface, and wherein the inner surface has diagonal symmetry about any plane that extends through the longitudinal axis of the body.

23. The air flow twisting device of claim 22, wherein each groove comprises a first side, a second side and a base, wherein a concave surface defines the first side and the base of each groove, a convex surface defines the second side of each groove and a junction between the concave and convex surfaces of each groove is a point.

24. The air flow twisting device of claim 22, wherein each groove begins at an end of the body and extends along a length of about two-thirds the length of the body.

25. The air flow twisting device of claim 22, comprising four grooves.

26. The air flow twisting device of claim 25, wherein each groove comprises a first side, a second side and a base, wherein a concave surface defines the first side and the base of each groove, and a convex surface defines the second side of each groove.

27. An air flow twisting device for an internal combustion engine for providing air for combustion to a combustion chamber of an engine, the device comprising:

a tubular body having a length and an inner surface; and a inner surface consisting of four identical grooves that twists along at least a portion of the length of the body such that air flowing through the body is caused to twist and thus have a twisting motion as it exits the body, wherein each groove spans only an arcuate portion of the inner surface.

28. The air flow twisting device of claim 27, wherein each groove further comprises a junction between the concave and convex surfaces that is a point.

29. The air flow twisting device of claim 27, wherein the inner surface has diagonal symmetry about any plane that extends through the longitudinal axis of the body.

* * * * *

UNITED STATES PATENT AND TRADEMARK OFFICE

CERTIFICATE OF CORRECTION

PATENT NO. : 6,938,608 B2
APPLICATION NO. : 10/376134
DATED : September 6, 2005
INVENTOR(S) : Wijaya It is certified that error appears in the above-identified patent and that said Letters Patent is hereby corrected as shown below:

| | |
|---|---|
| Column 1, line 20 | Delete "accessories",<br>Insert --accessory-- |
| Column 3, line 49 | Delete "imagine",<br>Insert --image-- |
| Column 4, line 14 | Delete "exists",<br>Insert --exits-- |
| Column 4, line 17 | Delete "existing",<br>Insert --exiting-- |

<u>In the Drawings</u>

| | |
|---|---|
| FIGs. 3 & 4, Sheet 3 of 7 | Delete Drawing Sheet 3 consisting of Figs. 3 & 4, and substitute therefore with replacement Drawing Sheet, consisting of Figs. 3 & 4, as shown on the attached page |

Signed and Sealed this

Seventh Day of November, 2006

JON W. DUDAS
*Director of the United States Patent and Trademark Office*